US006055793A

United States Patent [19]

Irwin et al.

[11] Patent Number: 6,055,793

[45] Date of Patent: May 2, 2000

[54] COMPACTION/CONTAINMENT BURIAL PROCESS

[76] Inventors: Eddie N. Irwin, 1103 Mescalero Dr., Truth or Consequences, N.Mex. 87901; Gregory F. Mathews, 611 Talwatha Dr., Prescott, Ariz. 86301

[21] Appl. No.: 09/206,250

[22] Filed: Dec. 7, 1998

[51] Int. Cl.[7] ..... B65B 1/24

[52] U.S. Cl. ..... 53/436; 53/527; 27/1

[58] Field of Search ..... 110/194; 53/527, 53/436; 27/1, 2, 35; 52/136

[56] References Cited

U.S. PATENT DOCUMENTS

| | | |
|---|---|---|
| 617,161 | 1/1899 | Hunter . |
| 1,373,014 | 3/1921 | Moore . |
| 2,562,726 | 7/1951 | MacDonald et al. . |
| 3,529,730 | 9/1970 | Thompson . |
| 3,654,675 | 4/1972 | Peterson . |
| 3,770,215 | 11/1973 | Wittke . |
| 3,898,718 | 8/1975 | Eubank . |
| 3,940,894 | 3/1976 | Nunes . |
| 3,990,198 | 11/1976 | Ortutay . |
| 4,607,417 | 8/1986 | Hancovsky . |
| 4,781,174 | 11/1988 | Gardner . |
| 4,893,385 | 1/1990 | Schrag . |
| 4,977,652 | 12/1990 | Graham . |
| 5,172,457 | 12/1992 | Allen et al. . |
| 5,287,603 | 2/1994 | Schorman . |
| 5,349,727 | 9/1994 | Niebergall . |
| 5,379,499 | 1/1995 | Jackson . |
| 5,732,452 | 3/1998 | Riedel . |

*Primary Examiner*—Daniel B. Moon
*Attorney, Agent, or Firm*—James F. Cottone

[57] ABSTRACT

An elongated containment tube is formed to serve as a retaining means during high-pressure compaction of ash resulting from cremation of humans and animals, and thereafter as an extended service life containment system for interment. In preferred embodiments, the containment tube may be made of various impervious metals, plastics, or ceramics, and employs one or more end caps having a range of sealing means that ensure high-integrity retention of its contents. End cap sealing means, such as circumferential deformable/deforming teeth and compression rings, are employed, and the long-term and stable burial of a large number of individual containment tubes in a single, conventionally sized grave plot is described.

8 Claims, 2 Drawing Sheets

FIG. 1
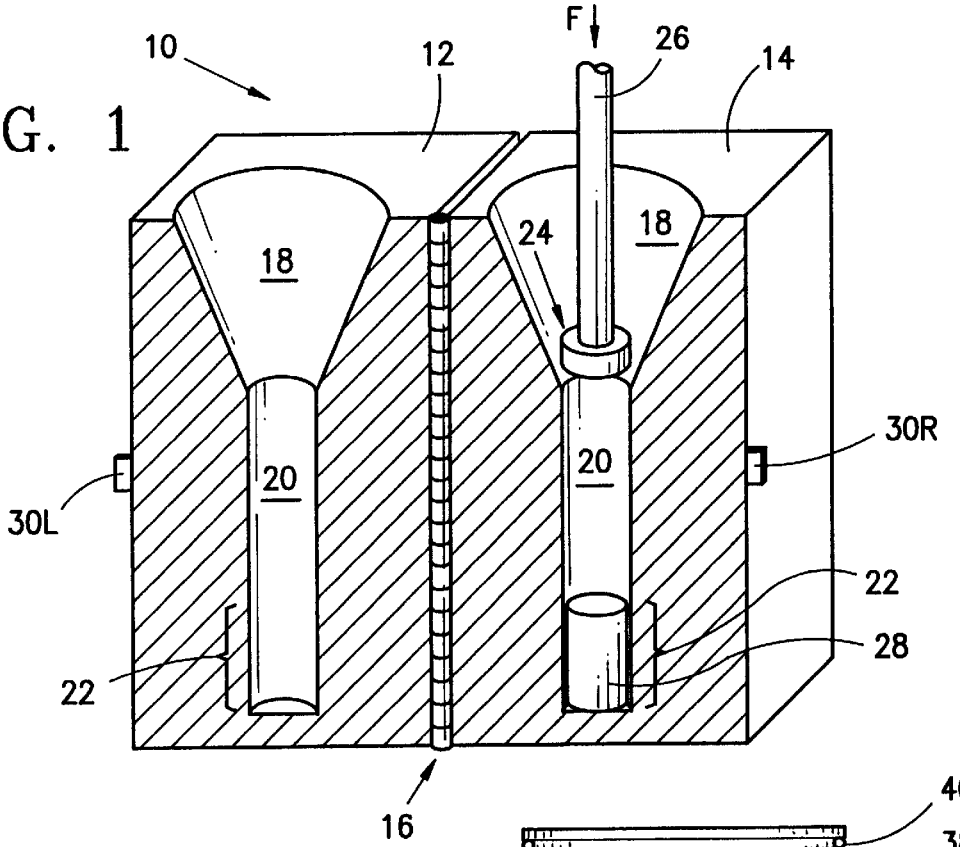
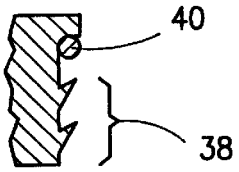
FIG. 2A
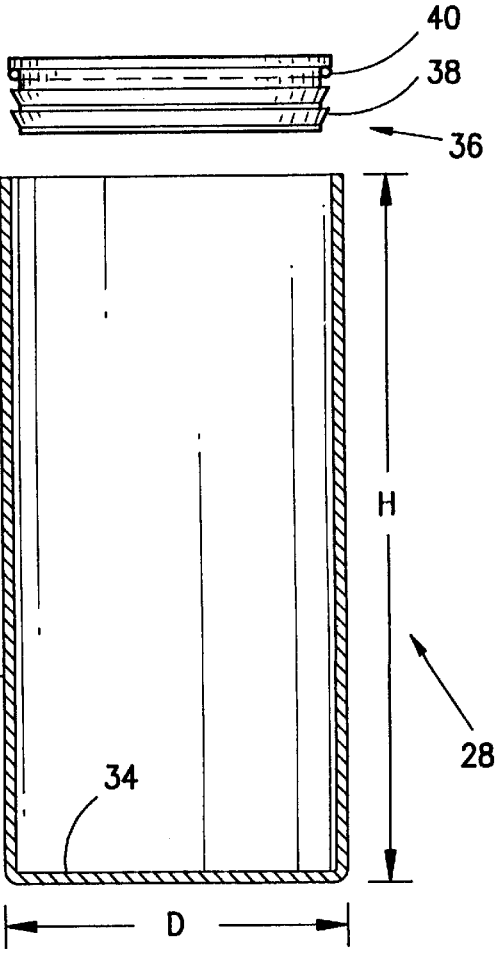
FIG. 2
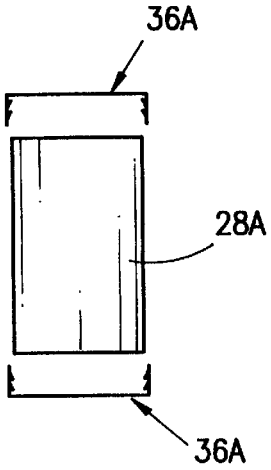
FIG. 2B

COMPACTION/CONTAINMENT BURIAL PROCESS

TECHNICAL FIELD

The present invention relates generally to processing and interment of cremated remains, and in particular to the compaction under high pressure of cremation ash into specially configured containment tubes to produce a highly stable and compact means suitable for long-term burial in space-efficient arrays.

BACKGROUND

Methods and apparatus for the dignified handling and burial of human remains have a long history of development, and people worldwide have evolved a variety of rituals and processes to fulfill these solemn tasks. One universal element in virtually all approaches to interment is a desire for a high degree of permanence in the processes invoked. Cremation of both human and animal remains also has a long history of usage in many cultures, and is recently becoming the process of choice for an increasingly large number of societies. Many factors are contributing to the recent shift away from conventional grave-site burials toward cremation, not the least of which are practical considerations. However, given the high cultural importance of burials, the primary humanitarian criteria for interment have always, and most likely will continue to prevail. These are: a universal desire for dignified handling of the deceased; a desire for permanence in the disposition of the resulting remains; and, oftentimes, a preference for a specific location for the final resting place of the remains.

Description of typical prior art approaches to processes and systems for producing and interment of cremated remains may be found in a number of U.S. patents.

U.S. Pat. Nos. 4,781,174 to Gardner and 3,770,215 to Wittke disclose processes for producing and handling cremation residues. In the 1988 Gardner patent, heat rays from the sun are concentrated and focused on a body as part of a funeral service to reduce it to ashes, and suggests presentation to the next of kin of ash compressed into a suitable urn for interment. The 1973 Wittke patent describes apparatus for receiving, cleaning, and comminuting cremation residues, and subsequently manually compressing the resulting ash into an urn.

A funiary urn in the form of a cylindrical canister is described in U.S. Pat. No. 5,172,457 to Allen et al. The urn includes a cap having a plurality of detents that mate with a corresponding plurality of grooves in the canister's outer wall to provide a substantially gas-tight fit.

U.S. Pat. Nos. 3,990,198 to Ortutay and 3,529,730 to Thompson provide teachings of post-cremation burial of human remains contained in urns. In the Ortutay patent a self-retaining barrel vault is described wherein a plurality of urn-holding elements is configured to interlockingly form the vault walls. The 1970 patent to Thompson describes an open frame structure for the interment of a plurality of individual storage tube urns containing cremated remains.

While each of these prior art approaches teaches one or another aspect of producing, processing, and burial of cremated remains, it is the unique combination of compaction/containment that the present invention admirably provides with its elegant and straightforward containment tube approach.

OBJECTS OF THE INVENTION

It is therefore a primary object of the present invention to provide an improved compaction and containment system for handling and storing the remains of deceased human and animals.

A further object of the present invention is to provide a process and a system for the high compaction of cremation ash into a containment tube suitable for long-term interment.

A still further object of the present invention is to provide a containment tube to both facilitate the compaction of cremation ash and to serve as an extended service life container for the compacted ash.

A yet further object of the present invention is to provide a compaction/containment system amendable to the burial of a large plurality of extended service life containment tubes within a conventional-sized grave plot.

In baseline and alternate embodiments, an elongated containment tube of nominally constant cross section along its length is formed to serve as both a confining container during a high-pressure ash compaction step, and an extended service life container thereafter when fitted with one or more precisely formed end caps. The end cap(s) include(s) circumferentially disposed teeth-like locking means for deformably engaging the inner or outer wall surfaces of the open-ended tubular container and may further include compression rings to improve the cap/tube seal. The combination of multi-element sealing means, and selection of impervious materials for the cap/tube members, ensures the long-term integrity of the compacted remains and precludes the entry of air, water, and other ambient contaminants. Burial of a large number of these hermetically sealed, long-life containment tubes containing the remains of related family members are preferably arrayed in a conventionally sized grave plot.

BRIEF DESCRIPTION OF THE DRAWINGS

Additional objects and advantages of the invention will become apparent to those skilled in the art as the description proceeds with reference to the accompanying drawings wherein:

FIG. 1 is a schematic view of a compression assembly for compacting the cremated remains of a human or pet into virtually solidified form according to the present invention;

FIG. 2 is a cross-sectional view of a containment tube for use with the present invention;

FIG. 2A is a partial cross-sectional view of sealing means for a containment tube cap;

FIG. 2B is a simplified schematic view of an alternate form of the end cap/containment tube interface;

BEST MODE FOR CARRYING OUT THE INVENTION

Figure 3:
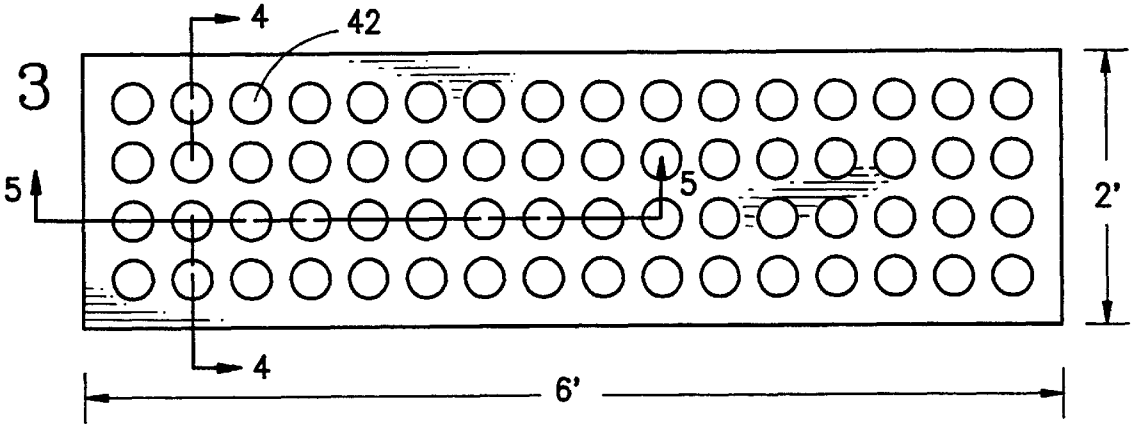
FIG. 3 is a top plan view of a grave-sized site for the interment of a plurality of individual containment tubes of cremated remains.

Referring now to FIG. 1, there is shown a compression assembly for compacting the ash that results from the cremation of humans or pets—hereinafter referred to as cremains—into solidified form according to the present invention. The assembly 10 is formed of two virtually identical half mold sections 12 and 14, which are pivotally interconnected by a piano hinge 16. The assembly 10 is shown in the opened position with each half section including a funnel-shaped input portion 18 at its upper end, a central compression shaft portion 20, and a containment tube region 22 at its lower end. The right half section 14 shows a compaction ram 24 adapted to be urged downward through the shaft portion 20 responsive to a compression force F applied via an input shaft 26. A cylindrical containment tube 28 is positioned in the region 22 of the half section 14.

In use, the assembly 10 is prepared to compress cremains by the emplacement of an empty containment tube in the region 22, pivoting the two half sections together and retaining them by a pair of latch members 30L and 30R, and slightly elevating the ram 24. Thereafter, cremains of an individual are poured into the input portion 18 to arrive in loose form into the containment tube 28, and may also partially extend into the lower end of the shaft portion 20. Upon application of the compression force "F" by any suitable means, such as hydraulic, pneumatic, or mechanical urging, the cremains are tightly compacted into the containment tube 28. Suitable choices of tube sizes, applied forces, and strengths of the compression tube and compression assembly ensure that the cremains are optimally compacted into containment tube 28. Compaction under high pressure not only produces a highly solidified ash, but also improves the long-term stability of the cremains and facilitates their indefinite storage.

An illustrative containment tube is described with reference now to FIG. 2. A cylindrical tube 28 having integrally formed sidewalls 32 and bottom end 34 is configured as an open-topped container of height "H" and diameter "D." In a preferred embodiment, the tube 28 is formed of stainless steel to provide a hermetically sealable container when fitted with a precisely machined tube cab 36. The cap 36 may include one or more circumferentially disposed locking teeth 38 and a compression ring 40, as shown in enlarged scale in a partial cross-sectional view of FIG. 2A. Typical overall tube dimensions are contemplated to be in the range of 2–6 inches in diameter and 6–12 inches in length. After the cremains have been compacted into containment tube 28, the filled tube is sealed by firmly urging the end cap 36 into the open tube top. The locking teeth 38 slightly deform the tube walls upon insertion, ensuring a tight mechanical grip of high integrity that does not yield over time, and the compression ring 40 of neoprene or other resilient materials ensures a hermetic seal. In preferred embodiments, various combinations of well-known sealing means beyond those shown here may be employed to ensure a seal impervious to air and water penetration. Sealing means adequate to support burial at sea or underwater are also contemplated.

Other alternate containment tube arrangements may include the use of a pair of end caps 36A which are compression-fitted over the outer walls of an open-ended sleeve-like container 28A, all as depicted in FIG. 2B. The end caps 36A may also include deformable teeth-like locking means (not shown to scale) as in those of FIG. 2A, as well as other well-known sealing means including one or more compression rings.

The cylindrical containment tube described thus far represents a preferred but baseline embodiment, and a number of variants are contemplated with respect to both the shape and materials that may be employed. Beyond the well-known desirable properties of stainless steel, the containment tube 28 may also be formed of other metals, such as aluminum, brass, and bronze. Molded ceramics and high-strength plastics may also serve well. Regarding shape, a range of alternate forms may readily be substituted for the baseline cylinder, such as elongated tubes having hexagonal, rectangular, or other cross sections. It is, however, desirable for best compaction that the cross section chosen be amenable to accommodating the compacting process without causing undue localized deforming stresses on the tube walls. This factor favors the use of tubes having cross sections more or less uniform over the tube length, but does allow for conical or pyramidal shapes of shallow side slopes. In considering the shape and materials for the containment tube 28, primary considerations lead to a choice of materials that provide a robust container of superior long-term stability that is hermetically sealable so as to provide containment impervious to contaminating ambient conditions, and shapes that provide a dignified and aesthetically pleasing repository for cremains.

In keeping with the containment burial aspect of the present invention, a number of approaches are contemplated, all having in common the interment of a plurality of containment tubes within a limited-sized burial plot. For illustrative teachings of post-cremation, above-ground burial arrangements, the interested reader is referred to the aforementioned U.S. Pat. Nos. 3,990,198 to Ortutay and 3,529,730 to Thompson. The Ortutay patent (issued in 1976) shows a system for sepulchral urn burial wherein a large number of individual urns are arrayed in separate blocks that form the sloping walls of a barrel vault. The Thompson patent (issued in 1970) shows a more conventional open-framed structure that supports a plurality of storage tubes for the interment of individually identified cremated remains.

Figure 5:
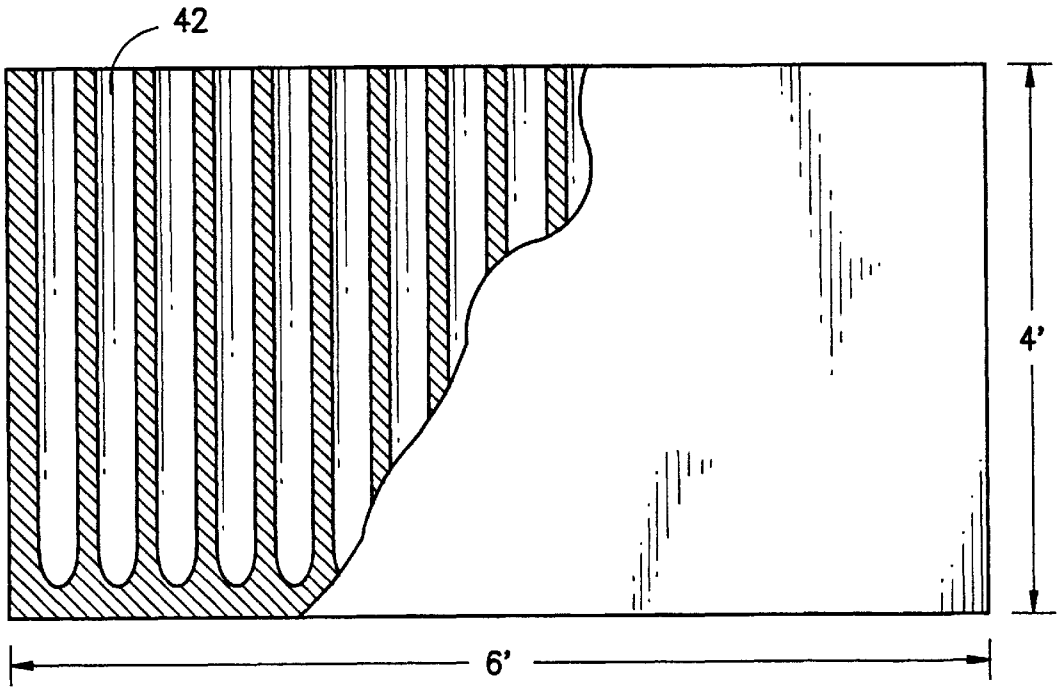
FIG. 5 is a cross-sectional view of the grave site of FIG. 3 taken along the lines 5—5.
Figure 4:
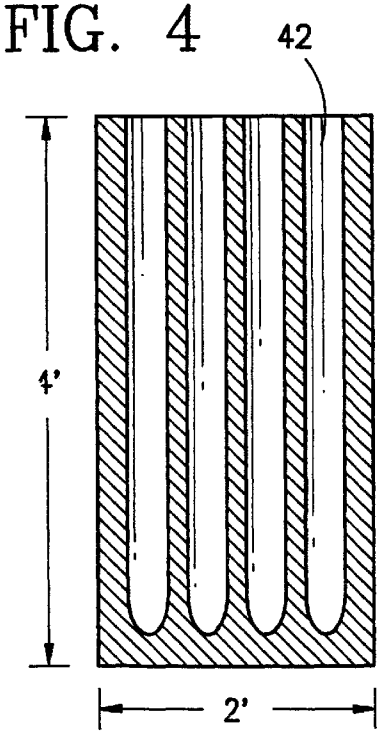
FIG. 4 is a cross-sectional view of the grave site of FIG. 3 taken along the lines 4—4.

Referring to FIGS. 3–5, a conventionally sized grave-site arrangement is shown for accommodating a large number of individual containment tubes. In the top view of FIG. 3, a horizontal array of vertically disposed tube-receiving openings 42 are shown fitted into a 2-foot by 6-foot plot. Reference to the lateral cross-sectional view of FIG. 4 shows the depth of each opening 42 to be just under 4 feet, thereby allowing the emplacement of approximately six individual containment tubes. For the illustrative 4×12 horizontal array of openings depicted, a large number of burial spaces are available, and each burial opening may hold up to six family members. This approach is considered particularly auspicious, because it permits a smooth integrating of interment modes by the utilization of existing grave plots in present-day cemeteries.

Although the invention has been described in terms of selected preferred embodiments, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. A method for compaction and containment of cremains comprising:

(a) providing a containment tube of deformable impervious material having at least one end opening and formed so as to be sealed by the compression fitted mating of an end cap with said end opening;

(b) compacting under high pressure a predetermined amount of cremains placed into said containment tube;

(c) providing at least one end cap having circumferentially disposed deformable means, and sealing said containment tube by compression fitted mating said end cap with said at least one end opening;

(d) whereby at least one containment tube filled with hermetically sealed compacted cremains is prepared for long-term interment in reduced space.

2. The method of claim 1 wherein said containment tube is an elongated cylindrical tube having one open end and said compacting step is accomplished by insertion of compacting means through said open end.

3. The method of claim 2 wherein said end cap further includes a circumferential compression ring to provide additional sealing of said containment tube.

4. The method of claim 1 wherein said containment tube is an elongated container having a uniform cross section along its elongated axis whereby said compacting step is facilitated without the creation of highly nonuniform stresses in said containment tube.

5. The method of claim 1 wherein said containment tube is formed as an elongated sleeve of uniform cross section having both ends open and adapted to be sealed by a pair of end caps, each end cap including at least one circumferentially disposed deformable element for providing an airtight sealing when compression fitted mated with its corresponding end opening.

6. The method of claim 5 wherein at least one of said end caps is sized so as to fit within said sleeve open end to provide said sealing.

7. The method of claim 1 wherein said impervious material is one selected from a group comprising stainless steel, brass, bronze, aluminum, and other metallic compounds as well as PVC and other plastics.

8. The method of claim 1 wherein said deformable means are teeth-like in cross section and are disposed along an outer circumferential surface of said end cap.

* * * * *